US007854198B2

(12) United States Patent
Groening et al.

(10) Patent No.: US 7,854,198 B2
(45) Date of Patent: Dec. 21, 2010

(54) DIRECT DRIVE

(75) Inventors: Ingolf Groening, Lohr am Main (DE); Anton Wirthmann, Gemuenden (DE); Stefan Steinbock, Urspringen (DE); Andreas Roesch, Karlstadt (DE); Wolfgang Sauer, Lohr am Main (DE)

(73) Assignee: Robert Bosch GmbH, Stuttgart (DE)

( * ) Notice: Subject to any disclaimer, the term of this patent is extended or adjusted under 35 U.S.C. 154(b) by 496 days.

(21) Appl. No.: 11/869,871

(22) Filed: Oct. 10, 2007

(65) Prior Publication Data

US 2008/0110356 A1 May 15, 2008

(30) Foreign Application Priority Data

Nov. 9, 2006 (DE) ..... 10 2006 052 763

(51) Int. Cl.
*B41F 5/00* (2006.01)

(52) U.S. Cl. ..... 101/216; 101/212

(58) Field of Classification Search ..... 101/216
See application file for complete search history.

(56) References Cited

U.S. PATENT DOCUMENTS 2,931,307 A * 4/1960 Smith ..... 417/357
3,987,323 A 10/1976 Hess
4,703,209 A * 10/1987 Wrobel ..... 310/67 R
5,115,738 A * 5/1992 Grutzmacher et al. ..... 101/216
5,704,288 A * 1/1998 John ..... 101/216
6,145,377 A * 11/2000 Nakasugi et al. ..... 73/483
6,688,222 B2 * 2/2004 Cattaruzza et al. ..... 101/212
6,987,336 B2 * 1/2006 Streng et al. ..... 310/51
7,533,610 B2 * 5/2009 Dittenhofer ..... 101/480
7,562,625 B2 * 7/2009 Mayr ..... 101/480
2002/0117911 A1 * 8/2002 Fukutani ..... 310/67 R

FOREIGN PATENT DOCUMENTS

DE 24 53 163 5/1976
DE 41 43 597 6/1998
EP 0 689 277 12/1995

* cited by examiner

*Primary Examiner*—Anthony H. Nguyen
(74) *Attorney, Agent, or Firm*—Michael J. Striker

(57) ABSTRACT

A direct drive for a printing press with lateral register adjustment includes a rotor and a stator, and a connection for mechanically connecting the drive with a stationary support bearing, wherein the rotor is connectable with shaft of a printing press cylinder with the connection being a torsionally stiff spacer installed directly or indirectly on the outer jacket of drive, which is designed to be elastic in the direction of the motor axis to compensate axial motions of the attachable printing press cylinder shaft.

7 Claims, 2 Drawing Sheets

DIRECT DRIVE

CROSS-REFERENCE TO A RELATED APPLICATION

The invention described and claimed hereinbelow is also described in German Patent Application DE 10 2006 052 763.1 filed on Nov. 9, 2006. This German Patent Application, whose subject matter is incorporated here by reference, provides the basis for a claim of priority of invention under 35 U.S.C. 119(a)-(d).

BACKGROUND OF THE INVENTION

The present invention provides a mounting for a drive of the type used in printing presses with lateral register adjustment.

Designs of this type are known from the related art. Publication DE 41 43 597 C2, for example, shows a printing press with a cylinder driven by an electric motor, the cylinder being displaceable in an axially longitudinal direction. The cylinder is driven by a direct drive. The lateral register adjustment is ensured, e.g., by utilizing the air gap between the stator and the rotor. In this design, the rotor or the stator must be designed longer in length, to ensure axial mobility without loss of torque. A greater amount of material must be used as a result, which results in higher costs.

SUMMARY OF THE INVENTION

It is therefore an object of the present invention to provide a cost-favorable printing press drive—which is easily replaced when service is performed—for printing presses with lateral register adjustment.

In keeping with these objects and with others which will become apparent hereinafter, one feature of the present invention resides, briefly stated, in a direct drive for a printing press with a lateral register adjustment, comprising an outer jacket; a rotor; a stator; a stationary support bearing; connecting means for mechanically connecting the drive with said stationary support bearing, with said rotor being connectable with a shaft of a printing press cylinder, wherein said connecting means is configured as a torsionally stiff spacer installed directly or indirectly on said outer jacket of the drive and configured to be elastic in a direction of a motor axis to compensate axial motions of said shaft at said printing press cylinder.

The present invention therefore provides a direct drive for a printing press with lateral register adjustment, in the case of which the drive includes a rotor and a stator, and connecting means for mechanically connecting the drive with a stationary support bearing, and the rotor is connectable with the shaft of a printing press cylinder; the connecting means is a torsionally stiff spacer installed directly or indirectly on the outer jacket of the drive, which is designed to be elastic in the direction of the motor axis to compensate axial motions of the attachable printing press cylinder shaft.

The advantage of the present invention is that the drive, as a complete unit, imitates the axial motion of the printing press cylinder and can be manufactured entirely independently of the configuration of the printing press. In addition, the drive can be built small and compact, because the entire length of the stator and the rotor is used to produce torque. When service is performed, the entire drive can be easily replaced, in direct contrast to the drive shown in the related art, which must first be released from its complicated support configuration in order to replace the individual parts of the drive.

The cross section of the connecting means is preferably designed to match the outer cross section of the drive, and it bears against the outer jacket or an intermediate bearing installed on the stator. An intermediate bearing can be required, in certain circumstances, when the axial force of the motor is inadequate to bring about a displacement against the force of the connecting element.

Particularly preferably, the connecting means are realized using a spring element, preferably a disk spring located on the circumference of the drive. The advantage of the disk spring is that it is designed to be torsionally stiff and axially non-rigid, which serves to provide spring action for the axial motion.

As an alternative, the connecting means can be realized using a cantilever, which supports the stator against a support bearing via at least one end face. The cantilever therefore replaces the disk spring mentioned above. The advantage of this variant is that the counterforces to be overcome in the axial displacement are particularly low. A design of this type would therefore be suited for use, in particular, with asynchronous machines and reluctance machines, in order to make use of the lesser return forces.

Particularly preferably, the outer cross section of the drive is designed essentially rectangular in shape, since this allows a large contact surface for the cross section of the support bearing—which is usually also rectangular in shape—to be realized. This also results in long spring travel, which results in less force being applied to move the printing press cylinder.

The drive preferably includes a feedback device, which is connected with the rotor and bears against the stator. When the shaft of the printing press cylinder undergoes axial displacement, the rotor, stator and sensor re displaced simultaneously and relative to the housing with the shaft. The sensor coupling is therefore very simple in design, and a separate, axially displaceable support of the sensor is not required.

When a printing press with lateral register adjustment is equipped with a direct drive of the type described in one of the preceding claims, a machine is obtained that is easy to maintain in terms of the direct drive, and that is easy to install. The motor can be installed and removed as a complete motor. Complex motor packages and bearings can be eliminated. The printing press can also be made more compact in design, since less installation space is required for the drive.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
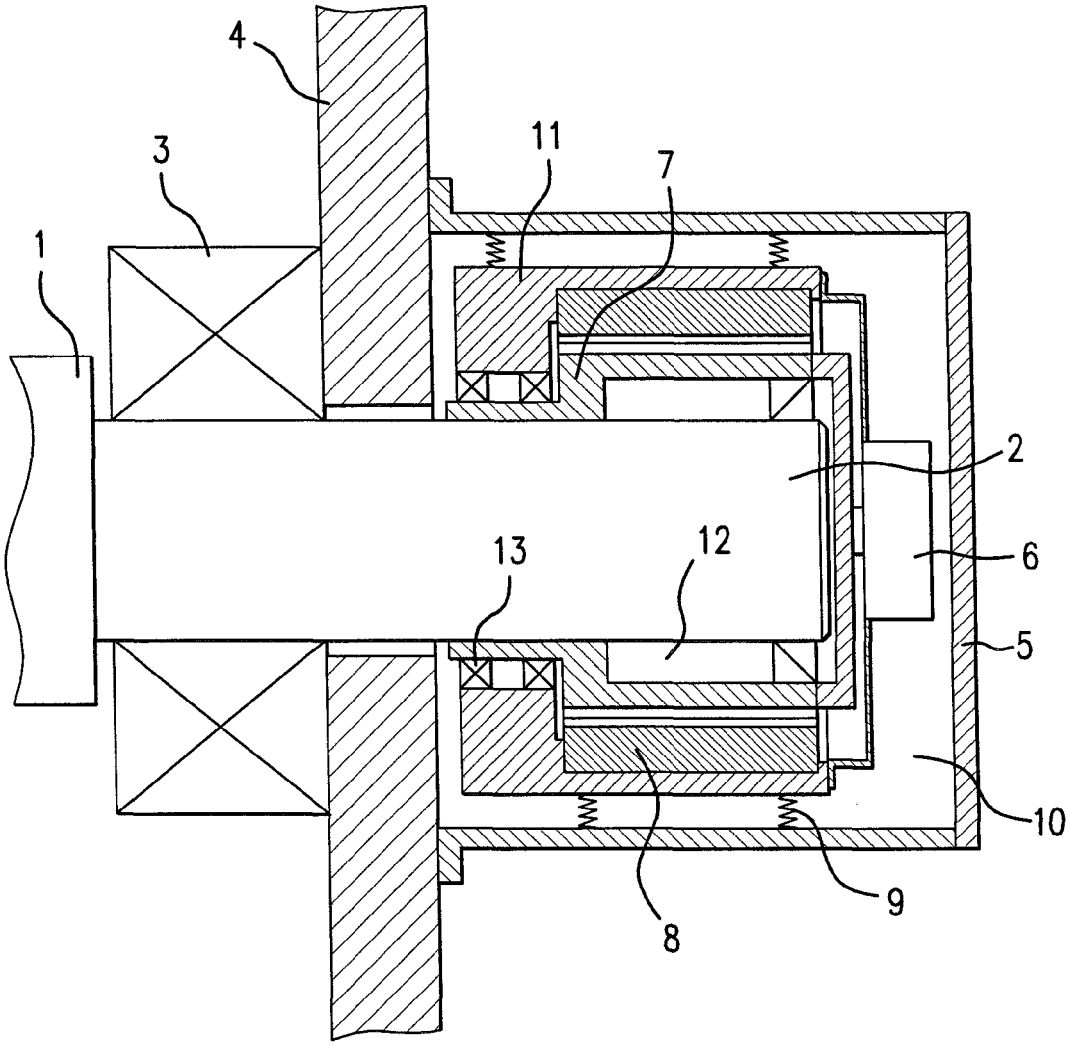
FIG. 1 is a view showing one variant of a direct drive in accordance with the present invention.

In the drawings a printing press cylinder 1 is provided with a printing press cylinder shaft 2 and a shaft bearing 3. The reference numeral 4 identifies a wall, while the reference numeral 5 identifies a housing. A feedback unit/sensor is identified with reference numeral 6, while a rotor and a stator are identified as 7 and 8, and a disk spring is identified as 9.

Finally, reference numeral 10 identifies a drive, while reference numerals 11, 12 and 13 identify a stator lock, a clamping element, and a stator-rotor bearing.

Figure 2:
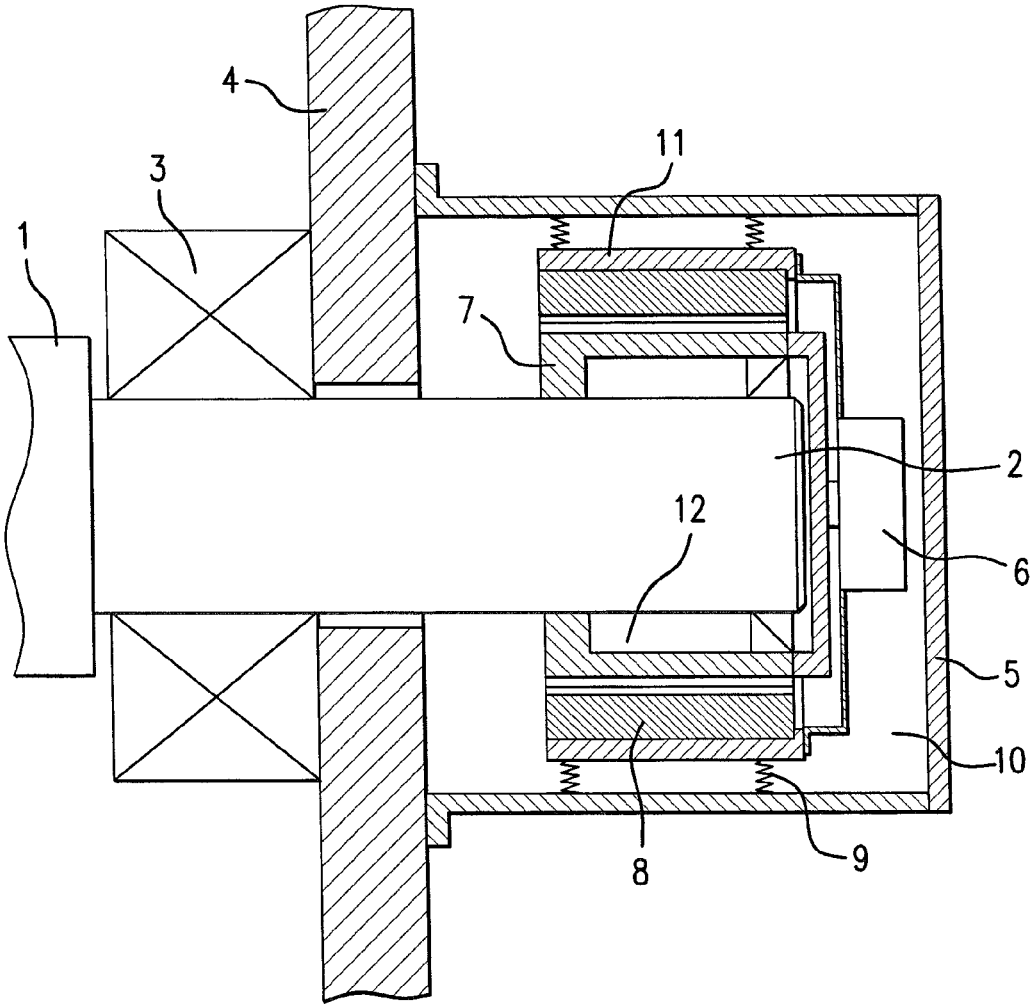
FIG. 2 is a view showing another variant of the direct drive in accordance with the present invention.

FIGS. 1 and 2 show two variants of inventive direct drive 10, whose rotor 7 is clamped on the shaft 2 of a roller 1 using the clamping element 12. The shaft 2 is supported via the shaft bearing 3. The shaft bearing 3 bears against the wall 4, through which the printing press shaft 2 is guided. The drive 10—which is covered by the housing 5—is located opposite to the bearing 3. The stator 8, the disk spring 9, the stator lock 11, the stator-rotor bearing 13 (FIG. 1 only) and the sensor 6 are also shown.

The variant of the present invention shown in FIG. 1 is the drive 10 without a permanent action of force, and the air gap of which is realized using the additional bearing 13 to lock the stator 8 in place. The rotor 7 of the drive 10 is located coaxial to the stator 8 due to its position on the circumference of the shaft 2. The air gap present between stator 8 and rotor 7 remains constant due to this support, even without the action of a magnetic field.

In the second variant shown in FIG. 2, the stator-rotor bearing 13 is not required, because a magnetic field is always present, so the air gap between the rotor 7 and the stator 8—which is required to operate the system—is automatically maintained.

In both cases, the drive is retained coaxially to the axis of rotation using the disk spring(s) (g), which is/are located between the outer circumference of the rotor lock 11 and the housing 5 of the drive 10. The disk spring(s) 9 is/are torsionally stiff, and it/they hold the drive 10 in an essentially constant position, even when shaft 2 rotates in the radial direction inside the housing. When the shaft 2 moves axially when performing a lateral register adjustment, however, the spring 9—which is non-rigid in the axial direction—yields and makes it possible for the system (cylinder 1+drive 10) to make a radially supported motion in the axial direction.

The sensor 6 is fixedly connected with the rotor 7 and is supported on the stator 8. When the shaft 2 moves in the axial direction, the drive 10 also moves in the axial direction, together with the shaft 2 and the sensor 6, inside the housing. When maintenance is performed, the drive 10 is easy to access by removing the housing 5. It can be pulled off of the shaft 2, allowing it to be replaced easily.

Instead of the disk spring 9, a cantilever structure could be provided, e.g., on the inside of housing cover 5 facing the stator 8, and on the end face of the stator 8, thereby allowing the system to be displaced axially. Cantilevers would also be feasible in other suitable locations.

It will be understood that each of the elements described above, or two or more together, may also find a useful application in other types of constructions differing from the type described above.

While the invention has been illustrated and described as embodied in a direct drive, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A direct drive for a printing press with a lateral register adjustment and a printing press cylinder with a shaft, comprising:

an outer jacket;

a rotor, said rotor being connectable with the shaft of said printing press cylinder;

a stator;

a stationary support bearing;

connecting means for mechanically connecting the drive with said stationary support bearing, wherein said connecting means is configured as a torsionally stiff spacer installed on said outer jacket of the drive and configured to be elastic in a direction of a motor axis to compensate axial motions of said shaft of said printing press cylinder.

2. A direct drive as defined in claim 1, further comprising an intermediate bearing installed on said stator, wherein said connecting means has a cross-section which is configured to match an outer cross-section of the drive, and it bears against said outer jacket of said stator in a manner selected from the group consisting of directly and indirectly via said intermediate bearing installed on said stator.

3. A direct drive as defined in claim 1, wherein said connecting means is configured as a spring element located on a circumference of the drive.

4. A direct drive as defined in claim 3, wherein said spring element of said connecting means is configured as a disk spring.

5. A direct drive as defined in claim 1, wherein the drive has an outer cross-section having a substantially rectangular shape.

6. A direct drive as defined in claim 1, further comprising a feedback device connected with said rotor and supported on said stator.

7. A printing press with a lateral register adjustment, the printing press comprising:

a printing press cylinder with a shaft;

a direct drive including an outer jacket, a rotor being connectable with the shaft of said printing press cylinder, a stator, a stationary support bearing, connecting means for mechanically connecting the drive with said stationary support bearing, wherein said connecting means is configured as a torsionally stiff spacer installed on said outer jacket of the drive and configured to be elastic in a direction of a motor axis to compensate axial motions of said shaft of said printing press cylinder.

* * * * *